US006045469A

United States Patent [19]

Gleason et al.

[11] Patent Number: 6,045,469

[45] Date of Patent: Apr. 4, 2000

[54] TUBULAR PROJECTILE FOR SPORT THROWING GAMES

[76] Inventors: Megan Gleason; Stetson Gleason, both of 466 N. State, Preston, Id. 83263

[21] Appl. No.: 09/006,340

[22] Filed: Jan. 13, 1998

[51] Int. Cl.[7] ..... A63B 41/00

[52] U.S. Cl. ..... 473/613; 273/DIG. 20

[58] Field of Search ..... 473/613, 612, 473/570, 595, 596, 597, 603, 604; 273/DIG. 20; D21/203, 204; 446/61; 62/457.4

[56] References Cited

U.S. PATENT DOCUMENTS

| | | | |
|---|---|---|---|
| 2,194,674 | 4/1940 | Riddell . | |
| 3,884,466 | 5/1975 | MacDonald et al. . | |
| 4,003,574 | 1/1977 | MacDonald et al. . | |
| 4,219,959 | 9/1980 | Fleischer . | |
| 4,736,948 | 4/1988 | Thomas . | |
| 4,887,814 | 12/1989 | Winter . | |
| 4,925,195 | 5/1990 | Di Manno | 473/613 |
| 5,000,451 | 3/1991 | MacDonald et al. . | |
| 5,033,743 | 7/1991 | Wright . | |
| 5,067,922 | 11/1991 | McMahon | 446/61 |
| 5,123,645 | 6/1992 | MacDonald et al. | 473/613 |
| 5,133,550 | 7/1992 | Handy . | |
| 5,224,704 | 7/1993 | Snell | 473/DIG. 20 |
| 5,280,906 | 1/1994 | Vitale . | |
| 5,458,329 | 10/1995 | Bushman et al. . | |
| 5,460,368 | 10/1995 | Pearson . | |

*Primary Examiner*—Steven Wong
*Attorney, Agent, or Firm*—Handal & Morofsky

[57] ABSTRACT

A tubular projectile for sport throwing games having an elongated body with a substantially symmetrical shape about its longitudinal axis, formed around a tubular axial hole. The body having substantially thin walls and a shallow curve running along its outer wall. The tubular axial hole is also configured to accept a beverage container, which will remain insulated by the projectile.

10 Claims, 6 Drawing Sheets

TUBULAR PROJECTILE FOR SPORT THROWING GAMES

The present invention relates to a tubular projectile for sport throwing games adopted to be thrown as a part of a sporting game and in addition is configured to serve as a beverage cooler when not being thrown.

BACKGROUND

Projectile for sport throwing games have been a long time source of entertainment at picnics, outdoor gatherings, and other outdoor social events. One such popular projectile for sport throwing games is the football.

For amateurs the throwing and catching of a football is very exciting when played as a team game. However, throwing and catching a football by two or more individuals can become uninteresting, tiresome, and oftentimes, boring. This can be due in part to the limited flight distance an amateur can realize and the difficulty an amateur has in achieving the necessary rotation and spiraling of the football that enables a stable and interesting flight trajectory.

In attempts to add more excitement and enjoyment to the mundane activity of individuals throwing a football at an outdoor gathering, there have been modifications made to a football to try and increase the flight distance, accuracy, and trajectory of the projectile for sport throwing games. These modifications have departed from traditional football design, and have created a new market for projectile for sport throwing games which bear some resemblance to the football.

For example U.S. Pat. No. 3,884,466 MacDonald et. al, discloses a GAME BALL with a hollowed out center portion to allow air to pass through it. The diameter of the hollowed out portion decreases as it approaches the center and then expands again at the opposite end, thereby increasing the flight distance and accuracy.

U.S. Pat. No. 5,133,550 Handy, discloses a FOOTBALL HAVING RAISED RIBS. The addition of raised ribs along the body of the football allow for a better grip and differing aerodynamic properties of the football when thrown.

U.S. Pat. No. 4,736,948 Thomas, discloses a FOOTBALL with a hollowed out center passage, and a pair of wind fins mounted within the passage. When thrown the wind fins are apparently meant to enhance the rotation of the ball.

U.S. Pat. No. 5,458,329 Bushman et. al., discloses a PLAY PROLATE SPHEROID GAME BALL. The ball is characterized by a cylindrical hole through the center and fins mounted to the outside to aid in spinning the ball.

U.S. Pat. No. 5,000,451 MacDonald et. al., discloses a GAME BALL having a hollowed out center passage and weighted material that responds to the spinning of the football by moving radially outward.

U.S. Pat. No. 5,460,368 Pearson, discloses a LIGHTWEIGHT BOUNCEABLE Projectile for sport throwing games PROVIDING SLOW ERRATIC FLIGHT. The device has a hollow center passage coupled with cut out design patterns along the body to cause an erratic flight path.

The aforementioned references are directed to projectile for sport throwing games that modify the design of a conventional football, while at the same time enabling an amateur user to enjoy the basic characteristics of a football. There continue to be improvements made in the design of projectile for sport throwing games, with the objects of minimizing the amount of skill required to participate in the activity while still providing enough excitement for continued enjoyment and of improving the performance limits of the projectile.

One drawback to the above prior art is that when it is not in use, the projectile for sport throwing games do not serve any useful purpose. They merely take up valuable cargo space in a car or travel bag that could otherwise be used more efficiently. For example, when packing for a camping trip space is at a premium, so there may be a point when recreational equipment is left behind in favor of more a practical necessity. But recreational equipment that also serves a useful purpose when not being utilized as a toy can be especially valuable. Therefore when one device can perform more than one function it allows other items to be taken along or it reduces the total amount of items that are brought on an outing.

The projectile for sport throwing games available on the market, such as those noted above, provide variations on the traditional design of a football. The present invention not only provides a new and useful improvement on the traditional design of a football it also serves a dual purpose that none of the prior art has addressed.

SUMMARY OF THE INVENTION

The invention, as claimed, is intended to provide a lightweight throwing toy. The present invention affords the user an exciting activity that can be performed at outdoor social events and can also be utilized indoors. Furthermore the present invention serves a dual purpose, not only can it be used as a football type projectile, it can also function as a beverage cooler.

The preferred embodiment of present invention comprises a lightweight high density foam plastic body, encased within a polymer coating, having a somewhat roughly cylindrical shape, with a tubular axial hole passing longitudinally through the body, and defining two opposite open ends, and having the a diameter which is greatest at the midpoint between the two open ends. The configuration of the inventive device allows the user to easily grip it within one hand, thereby permitting the device to be thrown to a playing partner.

When thrown the thin walled design coupled with shallow curvature of the outer wall, and the aerodynamics of the rounded leading and trailing edges provides a high speed projectile that can be accurately thrown over a great distance. While the resilient coating provides structural integrity and protection from damage, the lightweight high density foam body allows the device to be safely caught or accidentally impact an individual without causing injury.

The inventive device may also be configured with weights placed within and/or around the body to aid in flight stability. The weighting system can either be permanent in nature or it can be optimized by the user adding or removing weights depending on the wind and weather conditions.

In addition, the insulating properties of the high density foam plastic body provide superior insulating material, and renders the structure capable of keeping beverages cool on even the warmest of days. The device can also come in different sizes so as to fit the numerous types of beverage containers sold in the marketplace.

As can be clearly seen, the inventive device offers many advantages over other similar devices. Particularly the thin walled construction and shallow curvature of the body that allows a high speed accurate trajectory that is capable of traveling great distances combined with the ability to function as a beverage cooler causes the present invention to be far superior to previous devices of a similar nature.

BRIEF DESCRIPTION OF THE DRAWINGS

One way of carrying out the invention is described in detail below with reference to drawings which illustrate only one specific embodiment of the invention.

DETAILED DESCRIPTION OF THE PREFERRED EMBODIMENTS

Figure 1:
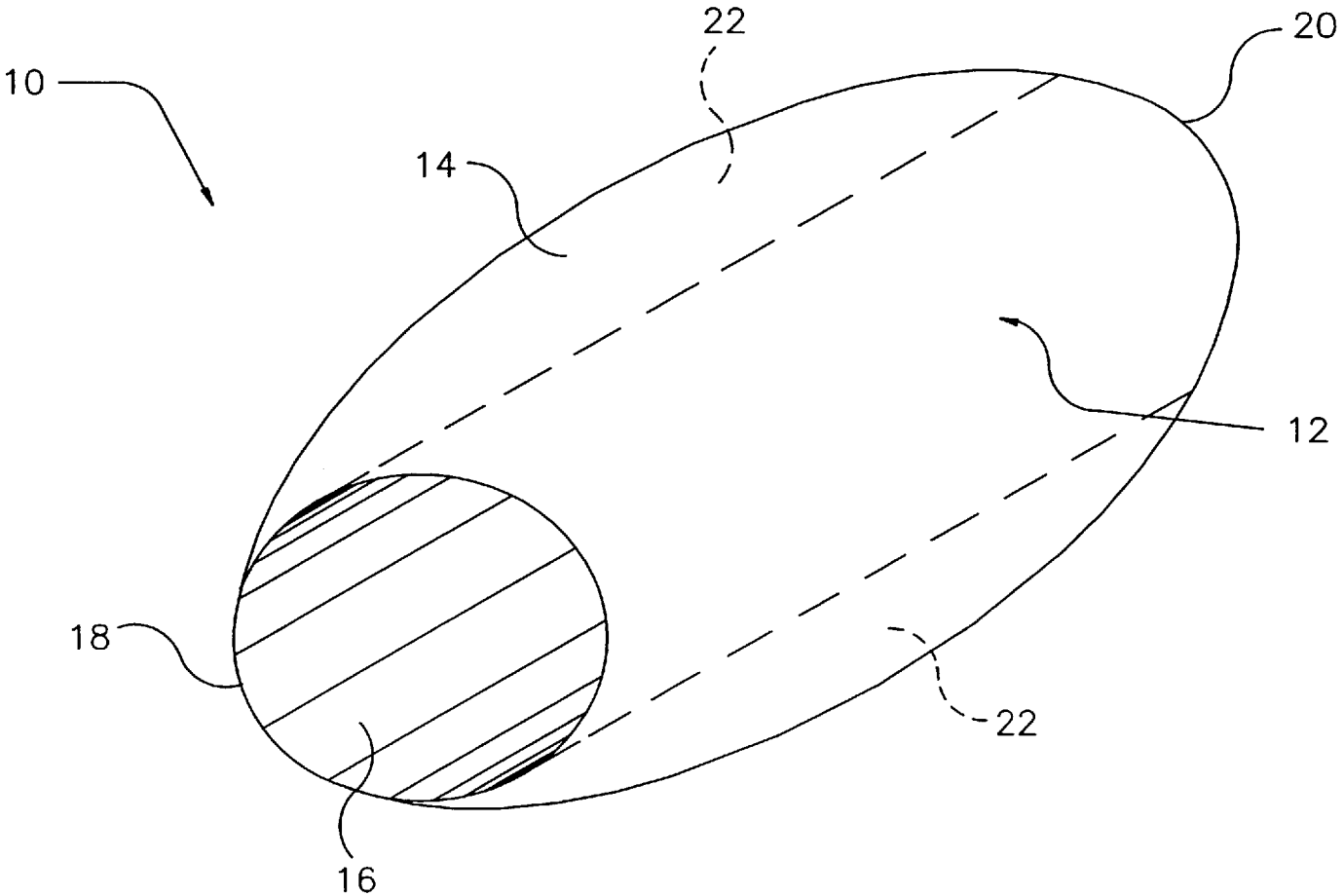
FIG. 1 is a perspective view of the present invention.
Figure 2:
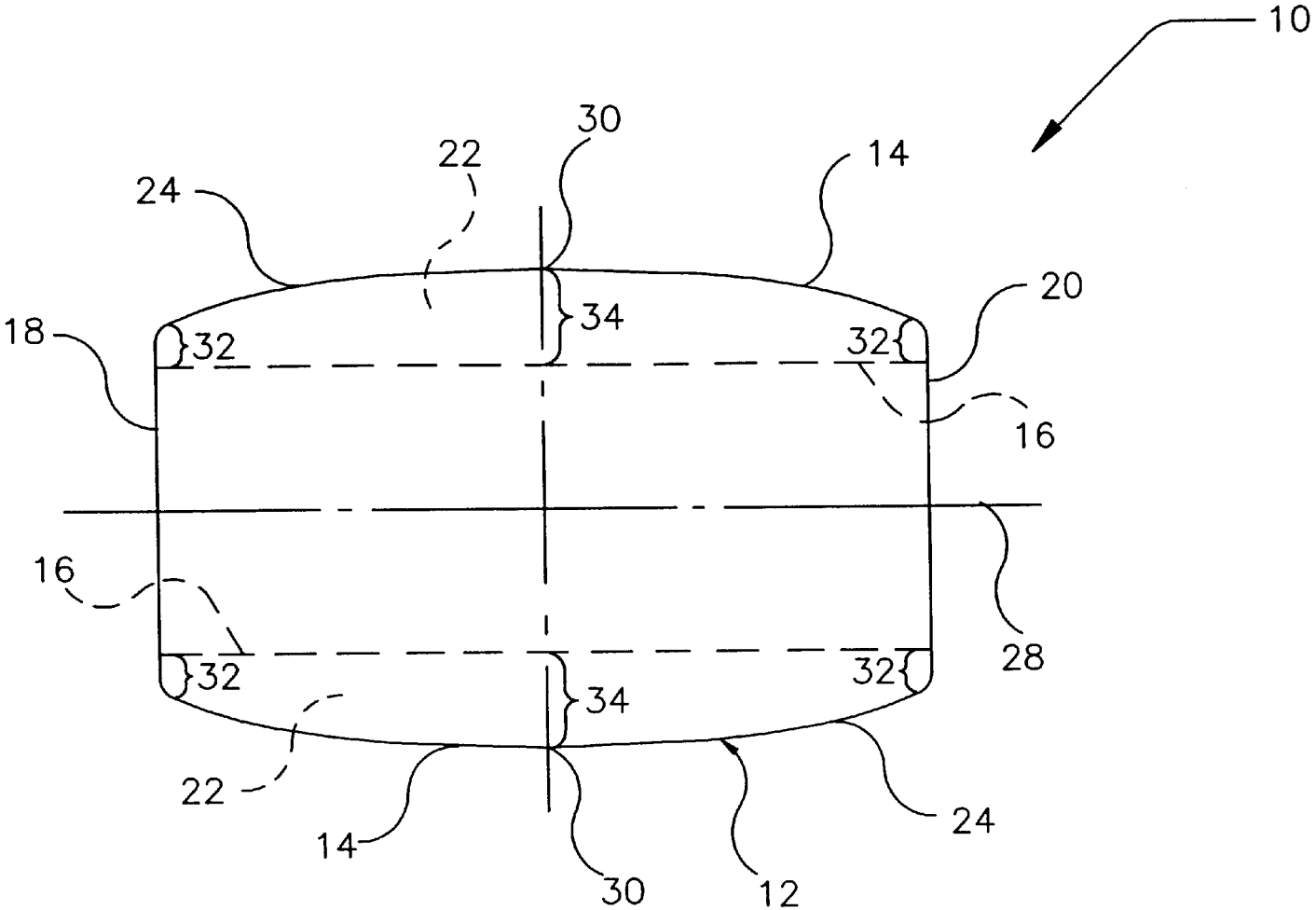
FIG. 2 is a side view of the elongated portion of the present invention.

Referring now to FIGS. 1 and 2, a tubular projectile 10 for sport throwing games is illustrated. Tubular projectile 10 is configured to have a body portion 12. Body portion 12 is configured to form the shape of an elongated tube. Body portion 12 defines an outer wall 14, and an inner wall 16. Body portion 12 also defines a first end cap portion 18, and a second end cap portion 20.

Figure 3:
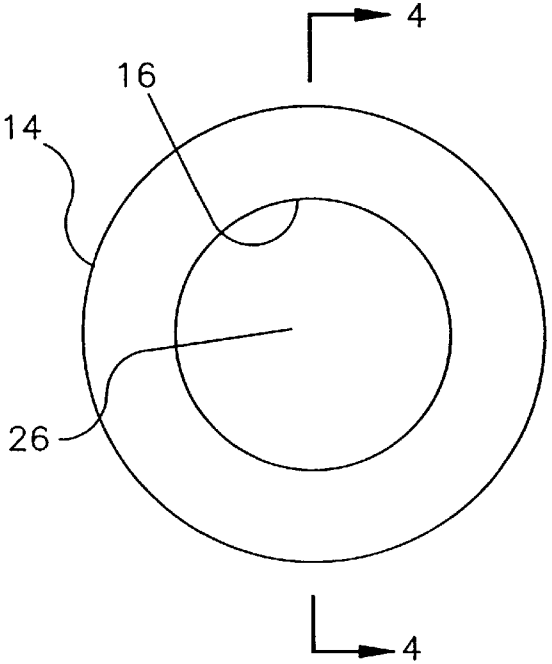
FIG. 3 is an end view of the elongated portion of the present invention.

Referring know to FIG. 3, projectile body portion 12 comprises a foam inner core 22 coated with a skin of polymer coating 24. Portions 14, 16, 18 and 20 are defined by an outer skin made of a tough damage resistant and preferably flexible material, such as PVC and having a thickness of several thousandths of an inch.

Inner core 22 is preferably constructed out of a high density foam plastic or any other material capable of providing the necessary structural integrity yet possessing sufficient insulating properties to keep a beverage cool. In addition, inner core 22 is lightweight allowing projectile 10 to have an extended period of flight. Polymer coating 24 provides a durable rigid covering to device 10.

Coating 24 is preferably made from a resilient material, but it could alternatively have elastic properties. Coating 24 is preferably made from a polymer having a sufficiently frictionless surface to allow the insertion of a beverage container, while still having enough resistance not to allow the container to easily fall out.

The resilient properties of inner core 22 and coating 24 allow projectile 10 to be deformed by forces exerted upon projectile 10. Once the forces are removed projectile 10 will return to its original undeformed shape. These features will protect an individual from substantial harm should they be accidentally struck by projectile 10. Moreover, projectile 10 may also be deformed by the user to vary its flight trajectory and/or allow projectile 10 to be fitted around a beverage container.

Projectile 10 can be manufactured with coating 24 on outer wall 14 while a differing coating or the coating being totally absent from inner wall 16. Alternatively, coating 24 may be present on inner wall 16 while a differing coating or the coating being totally absent from outer wall 14.

In yet another variation, the surface of coating 24 on inner wall 16 and/or outer wall 14 can be completely smooth or configured to have striations and/or dimples on coating 24. Such variations of coating 24 will ultimately affect the aerodynamic capabilities of projectile 10.

Referring now to FIGS. 2 and 3, an axial hole 26 runs through the length of the projectile 10 and is centered about an axis 28 of projectile 10. Outer wall 14 is formed such that it is at the greatest distance from axis 28 at a midpoint 30. Midpoint 30 is located halfway between front end portion 18 and second end portion 20.

The distance between inner wall 16 and outer wall 14 increases uniformly from a first thickness 32 at first end portion 18, and second end portion 20 to second thickness 34. Thickness 34 is configured to coincide with the midpoint 30 of projectile 10. Thickness 34 as compared to thickness 32 is optimally at a ratio of 1.3–1.8 to 1. This creates a smooth curve that defines the outer wall 14.

First portion 18 and second end portion 20 are aerodynamically curved so there is a smooth transition between the end portions and the inner and outer walls. The curve is such that it optimizes the aerodynamic properties of the projectile, while still providing the necessary structural integrity.

Figure 4:
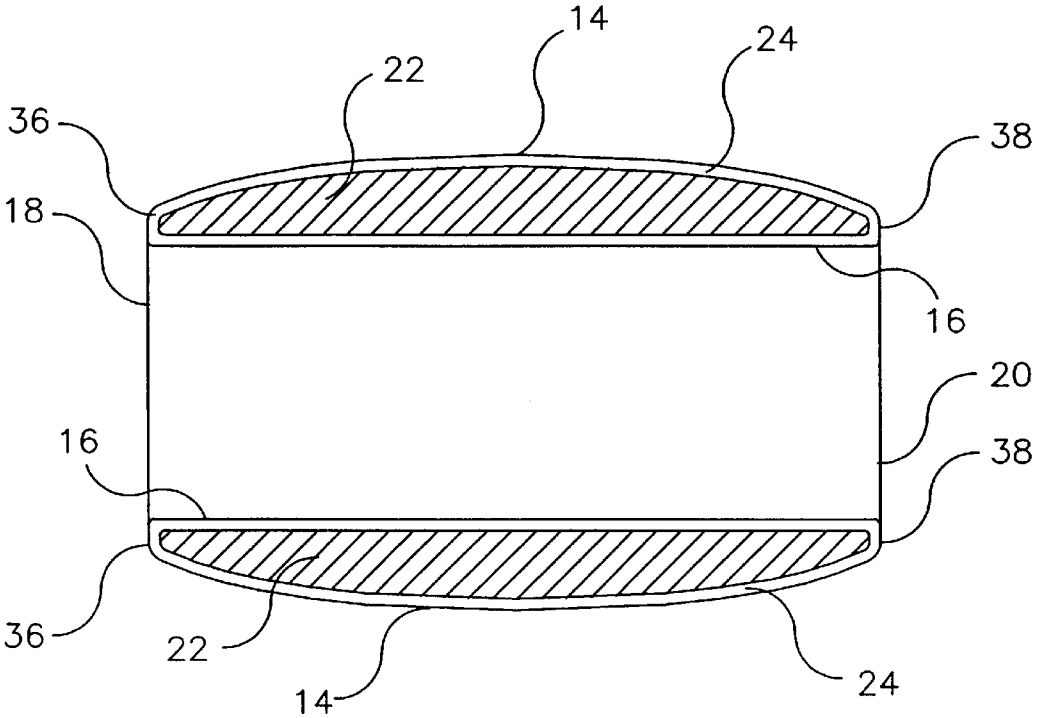
FIG. 4 is a cross sectional view of the present invention taken along lines 4—4 of FIG. 3.

Referring now to FIGS. 3 and 4, axial hole 26 passes longitudinally through body portion 12. The diameter of hole 26 is defined by inner wall 16. The diameter of hole 26 is slightly larger than the diameter of a beverage can 40. The diameter of hole 26 can be varied to accommodate many different types of beverage containers on the market.

Referring back to FIGS. 3 and 4, first end portion 18 is shown having an aerodynamically curved segment 36 spanning from inner wall 16 to outer wall 14. Segment 36 is preferably curved in such a fashion as to aid in the flight characteristics of projectile 10. Segment 36 can be manufacture as to have increasing coefficients of drag thereby creating different flight characteristics for the differing skill levels of participants using the device.

Similarly second end portion 20 has an aerodynamically curved segment 38, which can be identical to segment 36 or it can have a unique curvature so as to enhance the flight characteristics of the inventive device.

Figure 5:
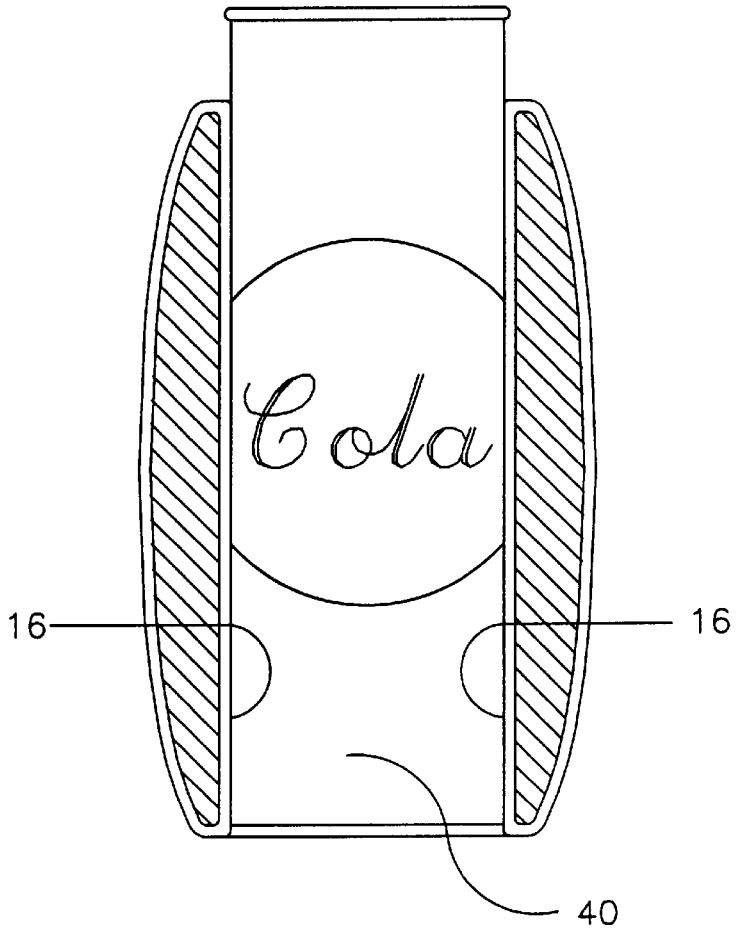
FIG. 5 is a partial cross-sectional view of the inventive device holding a beverage can.
Figure 6:
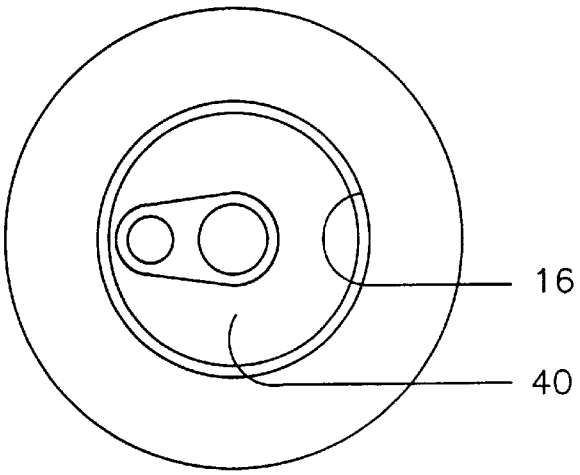
FIG. 6 is an end view of the elongated portion of the present invention holding a beverage can.

Referring to FIGS. 5 and 6, the inventive projectile 10 is shown holding a beverage container 40. The insulating properties of the high density foam plastic body provide superior insulating means capable of keeping beverages cool on even the warmest of days Projectile 10 can come in various sizes to fit numerous types of beverage containers sold in the marketplace.

Figure 8:
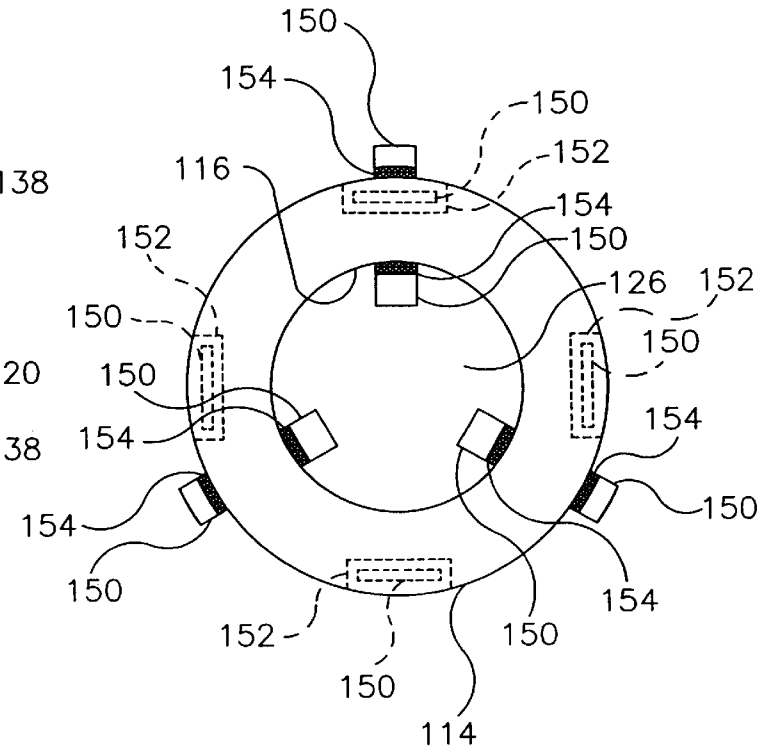
FIG. 8 is an end view of the FIG. 7 embodiment.
Figure 7:
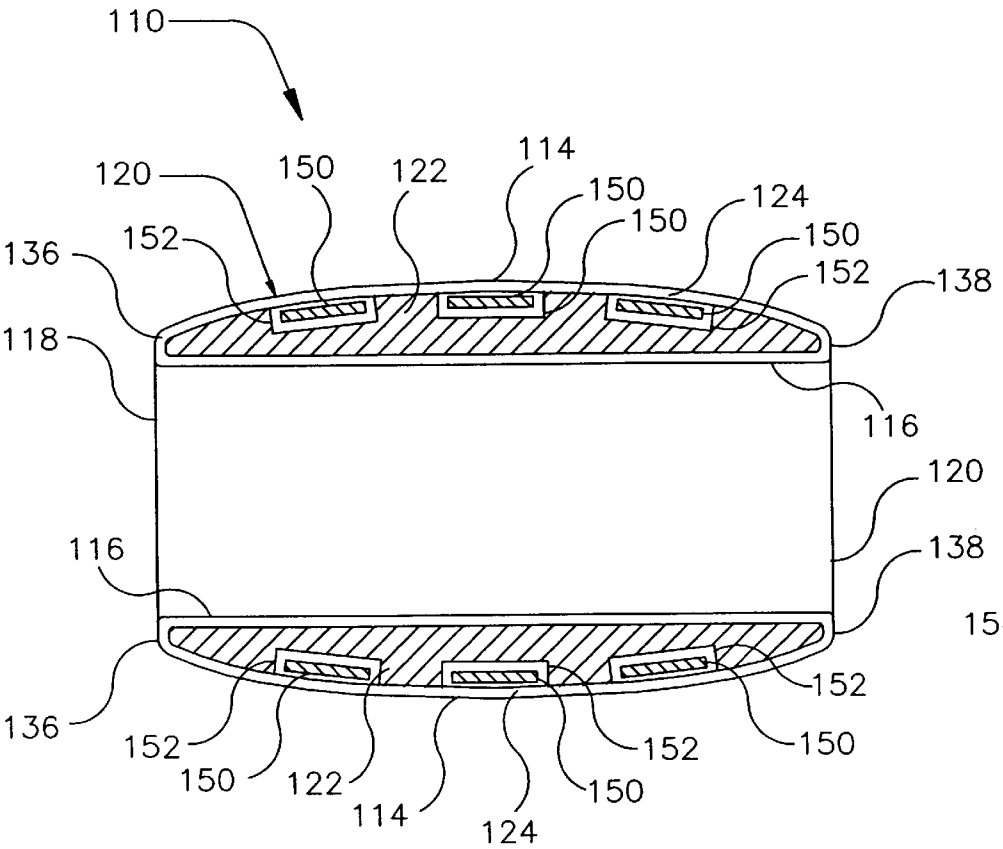
FIG. 7 is a cross-sectional view of an alternative embodiment of the present invention.

Referring to now to FIGS. 7 and 8, an alternative embodiment is illustrated. Here components and/or parts performing analogous or similar functions are numbered in multiples of 100. Body 120 is provided with a series of weights 150. Weights 150 are preferably made from a dense heavy material, but can be fashioned out of any suitable material such as lead, lead shot, steel, steel shot, heavy plastic, or encapsulated liquid or any other substance known or known in the future that provides adequate weighting.

Weights 150 are molded into inner core 122. The actual weight and placement of the weights 150 can be altered by the manufacturer to change the flight characteristics of the device so as to appeal to the differing skill levels of the participants. Alternatively, weights 150 may be placed within a cavity 152 as illustrated by the dashed lines in FIG. 7. In this configuration, weights 150 will be able to move within cavity 152 thereby affecting the flight trajectory of projectile 110 causing an erratic movement during flight.

In yet another alternative embodiment, weights 150 may be removably secured to outer surface 114 and/or inner surface 116. Such removable securement is provided by a VELCRO type attachment 154 or any other suitable means providing for a durable yet removable securement. In this configuration, the user may remove and/or replace the positioning of weights 150 to also affect the flight trajectory of projectile 110. Thus, the placement of weights 150 may be altered by the user to create varied flight paths or "trick" shots. Moreover, the positioning of weights 150 on the outer surface 114 and/or inner surface 116 of projectile 110 will also affect the aerodynamics of projectile 110.

Alternatively, weights 150 may be positioned inside inner core 122 and/or adhered to outer surface 114 and/or inner surface 116.

Figure 10:
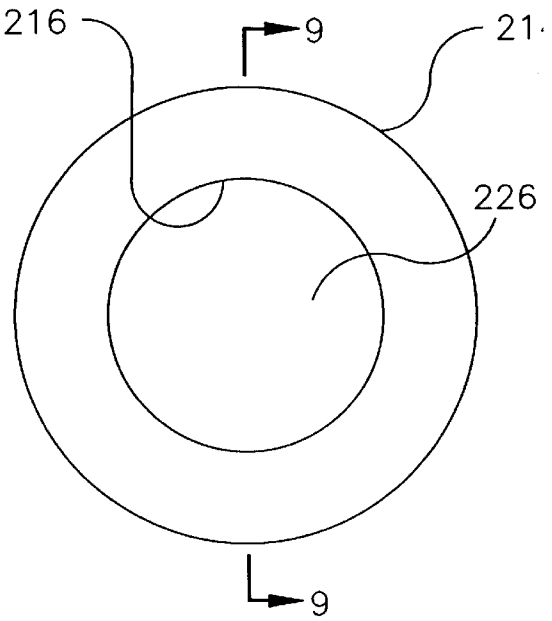
Figure 9:
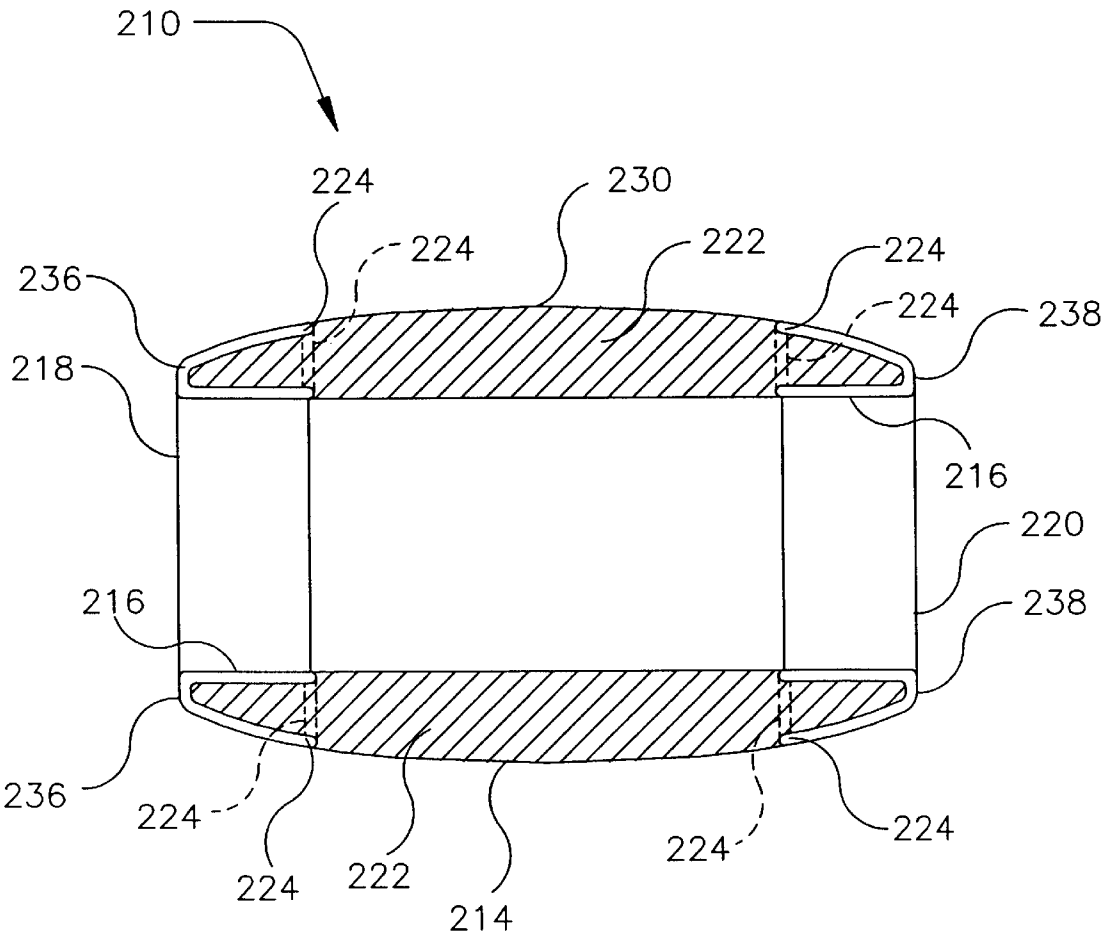

Referring now to FIGS. 9 and 10, another alternative embodiment is illustrated. Here coating 224 is limited to a first ring portion 218 and a second ring portion 220. Accordingly, coating 224 is positioned in areas of high impact while the remainder of inner core 222 is left uncovered. This feature allows for easy gripping and/or deformation of projectile 210 along its midpoint 230 while at the same time providing impact resistant ends.

Coating 224 may also be configured to completely encase inner core 222 as shown by the dashed lines in FIG. 9. In this embodiment inner core 222 within coating 224 may be of a different density from inner core 222 of the remainder of projectile 210. Alternatively, coating 224 may encase a weight 150 or a cavity 152 in which weight 150 may be placed. Alternatively, coating 224 may be configured to a form a solid ring portion to form ends 218 and 220.

While an illustrative embodiment of the invention has been described above, it is, of course, understood that various modifications will be apparent to those of ordinary skill in the art. Such modifications are within the spirit and scope of the invention, which is limited and defined only by the appended claims.

We claim:

1. A tubular projectile for sport throwing games comprising:

a) an elongated body substantially dimensioned to be grasped by the hand of a user in sport throwing game,
said body having an inside surface and an outside surface,
said body having a tubular shape,
said inside surface substantially dimensioned to conform to a standard aluminum can,
said tubular shape extending between an opening at a first end of said body and an opening at a second end of said body,
said first and second ends being rounded,
said body being configured to have a first thickness between its inside surface and its outside surface at said first and second ends and a second thickness between its inside surface and its outside surface at a point between said first and second ends,
said second thickness being substantially thicker than said first thickness;
wherein the circumference of said outside body at said point of second thickness is substantially dimensioned to be grippable by one hand of a user while drinking from said aluminum can,
said first thickness substantially dimensioned so that said user may drink out of said aluminum can while said can is disposed within said inside surface,
wherein the ratio of said second thickness to said first thickness is about 1.35 to 1;

b) an inner core defined between said inside surface and said outside surface of said body;

c) a plurality of weights dispersed throughout said inner core; and d) a flexible coating encasing said body.

2. A projectile as in claim 1, wherein additional weights are removably attached to the outside surface of said body.

3. A projectile as in claim 1 wherein said body is comprised of foam plastic.

4. A projectile as in claim 1 wherein said body has insulating properties.

5. A projectile as in claim 1 wherein said weights are fixedly attached within said flexible coating disposed over the outside surface of said body.

6. A projectile as in claim 1 wherein additional weights are fixedly attached onto the inside surface of said body.

7. A projectile as in claim 1 wherein said coating comprises a polymer having a sufficiently frictionless surface to allow the insertion of said aluminum can, while still having enough resistance not to allow the container to easily fall out.

8. A projectile as in claim 1 wherein said inner core comprises a material with resilient properties wherein said projectile will deform while a force is exerted upon said projectile but will return to its original undeformed shape once said force is removed.

9. A projectile as in claim 1 wherein additional weights are removably secured to said outer surface and/or said inner surface allowing a user to adjust the position of the weights.

10. A tubular projectile for sport throwing games comprising:

a) an elongated body comprising foam plastic and substantially dimensioned to be grasped by the hand of a user in a sport throwing game,
said body having an inside surface and an outside surface,
said body having a tubular shape,
said body comprising a material with insulating properties,
said inside surface substantially dimensioned to conform to a standard aluminum can,
said tubular shape extending between an opening at a first end of said body and an opening at a second end of said body,
said body being configured to have a first thickness between its inside surface and its outside surface at said first and second ends and a second thickness between its inside surface and its outside surface at a point between said first and second ends,
said second thickness being substantially thicker than said first thickness;
wherein the circumference of said outside body at said point of second thickness is substantially dimensioned to be grippable by one hand of a user while drinking from said aluminum can, said first thickness substantially dimensioned so that said user may drink out of said aluminum can while said can is disposed within said inside surface
wherein the ratio of said second thickness to said first thickness is about 1.35 to 1;

b) an inner core defined between said inside surface and said outside surface of said body wherein said inner core comprises a material with resilient properties wherein said projectile may be deformed when a force is exerted upon said projectile and then said projectile will return to its original undeformed shape once said force is removed;

c) a plurality of weights dispersed throughout said inner core; and d) a flexible coating encasing said body wherein said coating comprises a polymer having a sufficiently frictionless surface to allow the insertion of said aluminum can, while still having enough resistance not to allow the container to easily fall out.

* * * * *